US010830023B2

(12) United States Patent
Yang et al.

(10) Patent No.: US 10,830,023 B2
(45) Date of Patent: Nov. 10, 2020

(54) SHAPED CHARGE SYSTEM HAVING MULTI-COMPOSITION LINER

(71) Applicant: Schlumberger Technology Corporation, Sugar Land, TX (US)

(72) Inventors: Wenbo Yang, Sugar Land, TX (US); James Guilkey, Salt Lake City, UT (US); Lawrence A. Behrmann, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/966,045

(22) Filed: Apr. 30, 2018

(65) Prior Publication Data

US 2018/0245437 A1 Aug. 30, 2018

Related U.S. Application Data

(62) Division of application No. 14/628,353, filed on Feb. 23, 2015, now Pat. No. 9,976,397.

(51) Int. Cl.

| | |
|---|---|
| ***F42B 1/028*** | (2006.01) |
| ***E21B 43/117*** | (2006.01) |
| ***F42B 1/032*** | (2006.01) |

(52) U.S. Cl.

CPC ..... *E21B 43/117* (2013.01); *F42B 1/032* (2013.01)

(58) Field of Classification Search

CPC ..... F42B 1/032; F42B 1/028; F42B 1/036; F42B 3/28; C06B 45/30; E21B 43/117

See application file for complete search history.

(56) References Cited

U.S. PATENT DOCUMENTS

| | | | | |
|---|---|---|---|---|
| 2,856,850 | A * | 10/1958 | Church | F42B 1/02 102/307 |
| 3,478,685 | A * | 11/1969 | Thomanek | F42B 1/028 102/306 |
| 4,436,033 | A | 3/1984 | Precoul | |
| 4,498,367 | A | 2/1985 | Skolnick et al. | |
| 4,499,830 | A | 2/1985 | Majerus et al. | |
| 4,537,132 | A | 8/1985 | Sabranski et al. | |
| 4,672,896 | A | 6/1987 | Precoul et al. | |
| 5,614,692 | A | 3/1997 | Brown et al. | |
| 5,656,791 | A | 8/1997 | Reese et al. | |

(Continued)

FOREIGN PATENT DOCUMENTS

EP 0860679 A2 8/1998

OTHER PUBLICATIONS

International Search Report and written Opinion issued in the related PCT application PCT/US2016/018921 dated May 19, 2016.

(Continued)

*Primary Examiner* — Michael D David

(74) *Attorney, Agent, or Firm* — Cameron R. Sneddon

(57) ABSTRACT

A technique facilitates perforation, including the perforation of a casing and formation. A shaped charge is formed with a case, a liner, and a high explosive material located between the case and the liner. The liner is formed of a powder material, e.g. a powder metal material. The powder material properties of the liner between an apex of the liner and a skirt of the liner may be selectively varied to provide a desired jet velocity and jet mass of the liner upon detonation of the high explosive material.

17 Claims, 3 Drawing Sheets

(56) References Cited

U.S. PATENT DOCUMENTS

| | | | | |
|---|---|---|---|---|
| 5,753,850 | A | 5/1998 | Chawla et al. | |
| 5,792,977 | A | 8/1998 | Chawla | |
| 6,012,392 | A | 1/2000 | Norman et al. | |
| 6,021,714 | A | 2/2000 | Grove et al. | |
| 6,305,289 | B1 | 10/2001 | Mayseless et al. | |
| 6,349,649 | B1 | 2/2002 | Jacoby et al. | |
| 6,378,438 | B1 | 4/2002 | Lussier et al. | |
| 6,588,344 | B2 | 7/2003 | Clark et al. | |
| 6,840,178 | B2 * | 1/2005 | Collins | F42B 1/032 102/307 |
| 7,011,027 | B2 | 3/2006 | Reese et al. | |
| 7,712,416 | B2 | 5/2010 | Pratt et al. | |
| 7,762,193 | B2 | 7/2010 | Grove et al. | |
| 8,156,871 | B2 | 4/2012 | Behrmann et al. | |
| 8,166,882 | B2 | 5/2012 | Yang | |
| 8,302,534 | B2 | 11/2012 | Yang et al. | |
| 8,375,859 | B2 | 2/2013 | Sagebiel | |
| 8,381,652 | B2 * | 2/2013 | Glenn | F42B 1/028 102/306 |
| 8,449,798 | B2 | 5/2013 | Walker | |
| 8,555,764 | B2 | 10/2013 | Le et al. | |
| 8,584,772 | B2 | 11/2013 | Yang et al. | |
| 8,734,960 | B1 | 5/2014 | Walker | |
| 8,985,024 | B2 | 3/2015 | Yang et al. | |
| 9,175,936 | B1 | 11/2015 | Collier | |
| 9,188,413 | B2 | 11/2015 | McLean et al. | |
| 9,238,956 | B2 | 1/2016 | Martinez | |
| 9,360,222 | B1 | 6/2016 | Collier | |
| 9,441,924 | B1 | 9/2016 | Frericks | |
| 9,470,483 | B1 | 10/2016 | Wang | |
| 9,612,095 | B2 | 4/2017 | Smart et al. | |
| 2003/0183113 | A1 | 10/2003 | Barlow et al. | |
| 2004/0200377 | A1 | 10/2004 | Collins et al. | |
| 2004/0255812 | A1 | 12/2004 | Bourne et al. | |
| 2007/0051267 | A1 | 3/2007 | Meddes et al. | |
| 2008/0289529 | A1 | 11/2008 | Schilling | |
| 2012/0234194 | A1 | 9/2012 | Glenn | |
| 2016/0245053 | A1 | 8/2016 | Yang et al. | |

OTHER PUBLICATIONS

International Preliminary Report on Patentability issued in the related PCT application PCT/US2016/018921 dated Aug. 29, 2016 (9 pages).

International Search Report and Written Opinion issued in the related PCT application PCT/US2013/041039 dated Aug. 23, 2013.

International Preliminary Report on Patentability issued in the related PCT application PCT/US2013/041039 dated Dec. 23, 2014 (7 pages).

* cited by examiner

SHAPED CHARGE SYSTEM HAVING MULTI-COMPOSITION LINER

PRIORITY

This is a divisional application claiming priority to prior U.S. application Ser. No. 14/628,353, filed Feb. 23, 2015.

BACKGROUND

After drilling and casing of an oil or gas well, the well is opened to the surrounding formation for the ingress of oil or gas. The well is opened by perforating the casing and the rock formation beyond the casing using shaped charges. A shaped charge generally comprises a high explosive material located between a case and a liner. A portion of the liner forms a jet which is propelled away from the case when the shaped charge is detonated. The jet is propelled through the casing and into the formation to form a perforation which facilitates the ingress of oil and/or gas.

SUMMARY

In general, a system and methodology are provided for facilitating the perforation of a casing and formation. A shaped charge is formed with a case, a liner, and a high explosive material located between the case and the liner. The liner is formed of a powder material, e.g. a powder metal material. Parameters of the liner, between an apex of the liner and a skirt of the liner, may be selectively varied to provide a desired jet velocity and jet mass of the liner upon detonation of the high explosive material.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
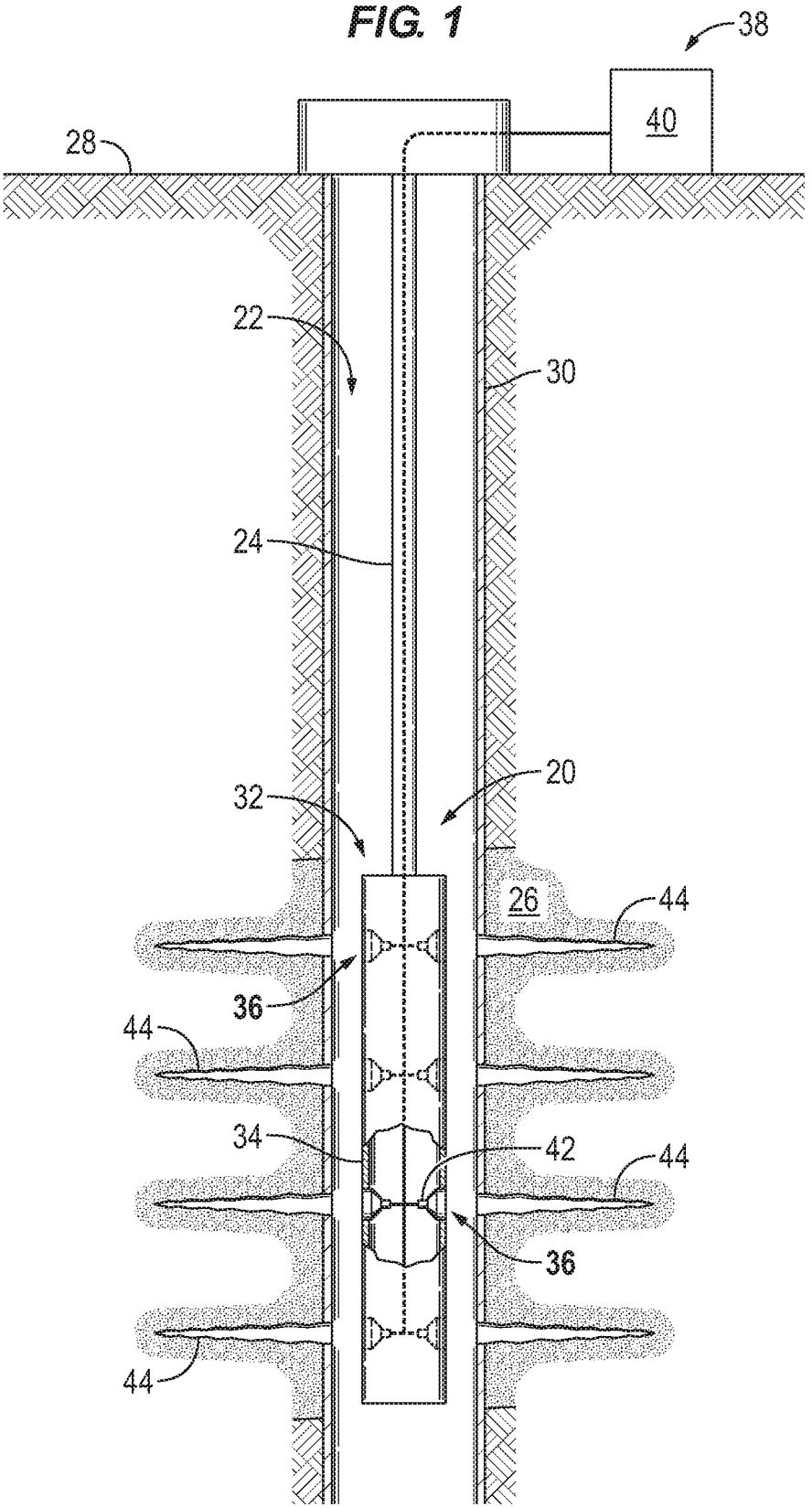
FIG. 1 is a schematic illustration of an example of a perforation system having a plurality of shaped charges deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate perforating, e.g. the perforation of a casing and formation to enhance production from an oil and/or gas well. The perforation may be performed by a perforating gun assembly deployed down into a wellbore via a suitable conveyance. The perforating gun assembly has a perforating gun body designed to hold a plurality of shaped charges oriented outwardly to form perforations into the surrounding formation upon detonation of the shaped charges.

Each shaped charge may be formed with a case, a liner, and a high explosive material located between the case and the liner. The liner is formed of metal and/or non-metal powder material. Upon detonation of the high explosive material, a portion of the liner is propelled as a jet which penetrates through the casing and into the surrounding formation. Characteristics of the jet, e.g. jet velocity and jet mass, may be adjusted by varying one or more characteristics, e.g. one or more compositional parameters, of the liner between an apex of the liner and a skirt of the liner. For example, the density of the powder used to form the liner may be selectively varied between the apex and the skirt of the liner to provide a desired jet velocity and jet mass of the liner upon detonation of the high explosive material. However, additional or other compositional parameters of the liner also may be varied to achieve a desired perforation. Examples of these other compositional parameters include powder particle diameter distribution, hardness, ductility, porosity, and abrasiveness.

In an embodiment, the liner is formed from a powder material having a composition which varies between an apex of the liner and a skirt of the liner. Examples of the powder material include various metal powder materials although other powder materials may be used in the mixture. In some embodiments, ceramic powders or other non-metal powdered materials may be added to vary the mix of powder material between the apex and the skirt of the liner. Depending on the specifics of the application and/or environment, different powder metal mixes including metals alone or combined metals and non-metals may be used between the liner apex and the liner skirt.

The variable powder metal/powder material mixture along the liner may be used to optimize the performance of oilfield perforators. For example, variation in compositional parameters along the liner may be used to achieve deeper penetration, larger casing entrance hole diameter, increased casing hole diameter plus deeper penetration, and other enhancements related to perforating gun exit hole diameter as well as casing/formation penetration characteristics. In some embodiments, the mix of the powder material at the first portion or apex of the liner can be formed with a different powder mixture, say mixture 1, compared to the mix of powder material, say mixture 2, through the remainder of the liner or vice versa.

Referring generally to FIG. 1, an example of a perforating system 20 is illustrated as deployed in a wellbore 22 via a conveyance 24. In this example, the wellbore 22 extends into a subterranean formation 26 from a surface location 28 and is lined with a casing 30. The perforating system 20 comprises a perforating gun 32 having a perforating gun body 34. The perforating gun body 34 may have a variety of structures and may be constructed with many types of components. A plurality of shaped charges 36 is mounted to the perforating gun body 34, and each of the shaped charges 36 is oriented outwardly from the gun body 34.

The shaped charges 36 are connected with a detonation system 38 having a detonation control 40 which provides signals to a detonator or detonators 42 to initiate detonation of shaped charges 36. In many applications, the detonation system 38 may utilize a detonator 42 in the form of detonation cord properly positioned to initiate detonation of the shaped charges 36. When detonator 42 comprises detonation cord, the detonation cord is routed to the shaped charges 36 and portions of the detonation cord are placed into cooperation with explosive material located in the shaped charges 36. In some applications, the shaped charges 36 are placed in a staggered pattern along the perforating gun body 34 and linked by the detonator/detonation cord 42 which is routed back and forth between the staggered shaped charges 36. The detonation cord enables a desired, controlled detonation of the plurality of shaped charges. Upon detonation, the shaped charges 36 explode and create a jet of material which is propelled outwardly to create perforations 44 which extend through casing 30 and into the surrounding subterranean formation 26. The number and arrangement of shaped charges 36 can vary depending on the parameters of a given perforation application. Additionally, the shaped charges 36 may be detonated in separate groups; or a plurality of perforating guns 32 may be employed to perforate different zones of subterranean formation 26.

Figure 2:
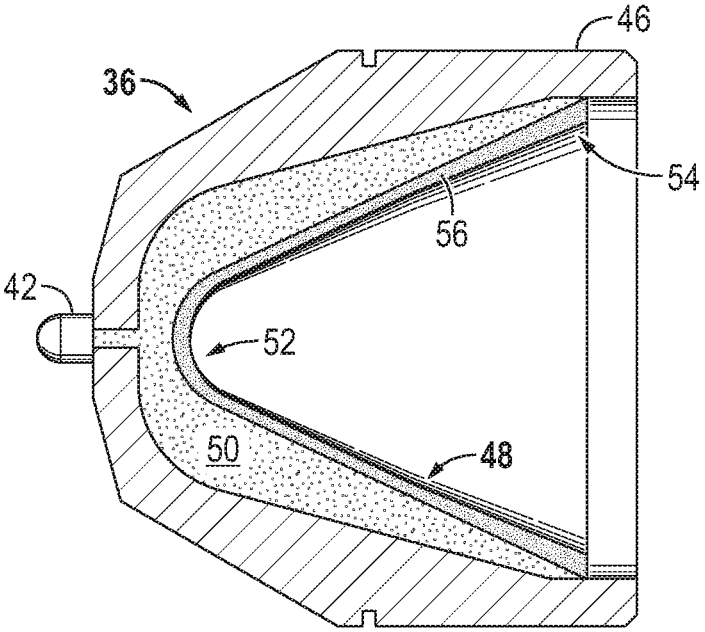
FIG. 2 is a cross-sectional view of an example of a shaped charge, according to an embodiment of the disclosure.

Referring generally to FIG. 2, an example of one of the shaped charges 36 is illustrated. In this embodiment, shaped charge 36 comprises a case 46, a liner 48, and a high explosive material 50, e.g. a high explosive pellet, positioned between the case 46 and the liner 48. The liner 48 extends generally between a first portion or apex 52 and a second portion or skirt 54. By way of example, the liner 48 may be cup-shaped with the apex 52 forming the bottom of the cup and the skirt 54 forming the rim of the cup. The liner 48 is formed with a powder material 56 having characteristics which change between the apex 52 and the skirt 54. In some applications, however, non-powdered material also may be combined into the liner 48 to help provide the changing characteristic or characteristics.

For example, the liner 48 may be constructed such that the powder material 56 has differences in compositional parameters, e.g. powder density or other material properties, moving from the apex 52 to the skirt 54. The differences in material properties may be selected to optimize or otherwise adjust the jet velocity and jet mass of the liner 48 upon detonation of explosive material 50. The changes in compositional parameters may be achieved by utilizing a variety of powder material blends, e.g. mixtures, between the apex 52 and the skirt 54. In some applications, the powder material 56 may have a changing proportion of materials along the axis of the liner 48 (i.e. varied between the apex 52 and the skirt 54) to achieve a desired continuity of liner properties, e.g. continuity of density or mass, with a corresponding, desired jet velocity and jet mass. The changing characteristic, e.g. changing material properties, along the liner 48 may be achieved by a variety of powder material techniques. However, the liner 48 also may be constructed via three-dimensional (3-D) printing techniques which enable variation of material properties, e.g. variation of material compositional parameters, at different regions throughout the liner 48. For example, 3-D printing techniques may be used to control and vary the porosity along liner 48 to obtain desired jet properties.

By way of example, the powder material 56 used to form liner 48 may be a powder metal material. The powder metal material may be formed from various mixtures of metal powders (or metal and non-metal powders) depending on the perforating characteristics desired for a given application. Examples of metal powders include tungsten (W) powder, copper (Cu) powder, lead (Pb) powder, titanium (Ti) powder, and other metal powders. The various metal powders may be mixed in many different types of compositions and those compositions may be varied between the apex 52 and the skirt 54 of liner 48. The composition of the powder metal material 56 and the differences in composition moving from the apex 52 to the skirt 54 is selected to achieve different perforating characteristics upon detonation of the explosive material 50.

The powder material composition and the change in powder material compositional parameters between the apex 52 and the skirt 54 may vary substantially depending on the overall design of the shaped charge 36, casing 30, type of rock in formation 26, and various other system and environmental parameters. Various mixtures of powder materials having different powder material densities, diameter distributions, hardness characteristics, ductility characteristics, and/or abrasiveness characteristics may be used to achieve the desired perforations. It also should be noted that the powder material 56 may comprise non-metal powder components. For example, ceramic powders or other non-metal powders may be used to form portions of liner 48 or they may be mixed with the metal powders to create desired material characteristics and changes in those characteristics moving from the apex 52 to the skirt 54. Different density powder materials such as tungsten powders and ceramic powders may be used in differing concentrations along the liner to create lower density and higher density portions of the liner 48.

Figure 3:
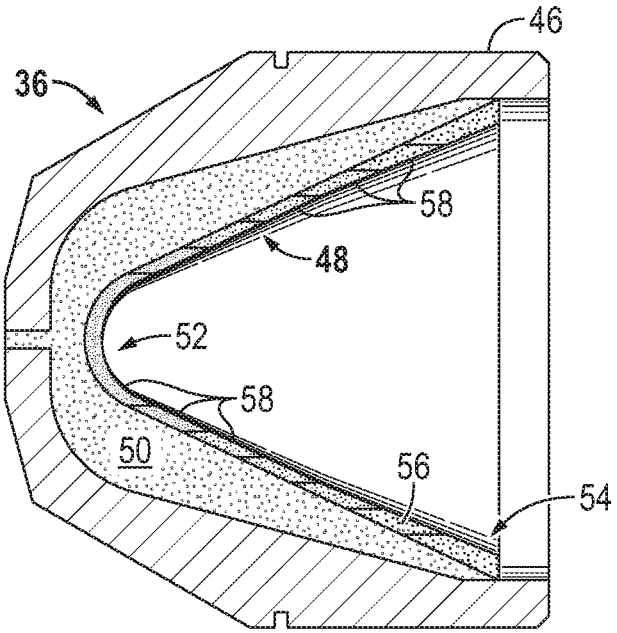
FIG. 3 is a cross-sectional view of another example of a shaped charge, according to an embodiment of the disclosure.

Referring generally to FIG. 3, another embodiment of shaped charge 36 is illustrated. In this embodiment, the liner 48 is constructed of powder material 56 having differing compositions moving from the apex 52 to the skirt 54. The liner 48 is constructed with a plurality of discrete segments 58 in which at least some of the discrete segments 58 have different material compositions relative to each other. The discrete segments 58 may each be formed of different compositions of metal and non-metal powders, as discussed above, to achieve desired perforating characteristics. For example, segments 58 at or close to apex 52 may be formed from lower or higher density powder materials, (e.g. powder materials having lower or higher concentrations of low-density constituents such as tungsten powders or ceramic powders) to achieve a desired jet velocity and jet mass upon detonation of explosive material 50. Depending on the application, the liner 48 may comprise two, three, four, or more different metal and/or non-metal powder material mixtures moving from the apex 52 to the skirt 54. The content and arrangement of those segments 58 can be adjusted depending on the desired perforator performance in any given target.

Figure 4:
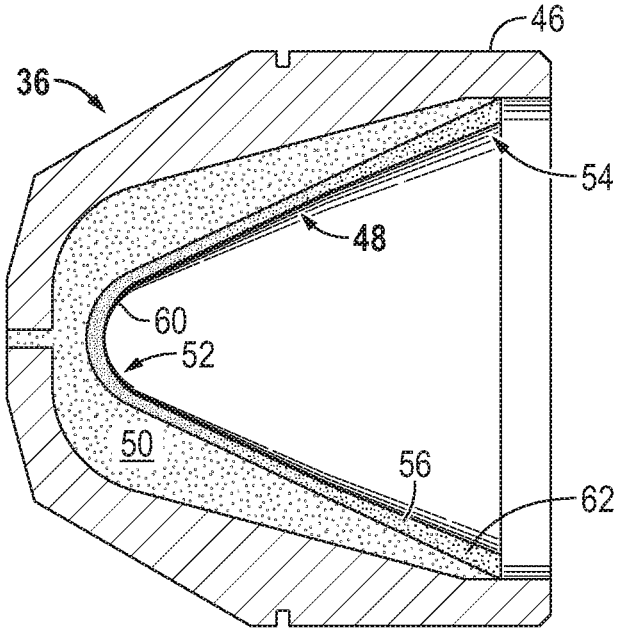
FIG. 4 is a cross-sectional view of another example of a shaped charge, according to an embodiment of the disclosure.

In the embodiment illustrated in FIG. 4, the liner 48 has been constructed with powder material 56 having a material composition which varies continuously from the apex 52 to the skirt 54. The continuous variation of material composition may be based on variation of any of a variety of parameters moving between apex 52 and skirt 54 of liner 48. For example, the density of the powder material 56 forming liner 48 may be varied continuously in an axial direction along the liner 48. In the example illustrated, the density of liner 48 varies continuously from a low-density region 60 located at apex 52 to a higher density region 62 located at skirt 54. The density of the powder material 56 and/or other compositional parameters may be varied to different degrees and in differing directions depending on the desired characteristics of the jet created by liner 48 upon detonation of explosive material 50.

As discussed above, the powder material 56 may incorporate a variety of powder materials, such as tungsten, copper, lead, titanium, ceramic, and/or other types of powder materials. Additionally, the powder material 56 may incorporate a binding material formed as a coating or other type of layer on the powder materials used to form the liner 48. The concentration and/or mixture of components also may be varied between discrete segments 58 of the liner, continuously, or according to other patterns between the apex 52 and the skirt 54 of the liner 48.

When liner 48 is constructed of distinct segments 58, certain compositions of the segments can create sudden density/mass changes which create discontinuities of the jet resulting from detonation of explosive material 50. In some applications, the discontinuities can be useful and in other applications the discontinuities can be reduced or minimized by engaging adjacent liner segments 58 gradually. For example, the plurality of segments 58 may be matched together gradually moving from the apex 52 to the skirt 54. Depending on the application, various structural changes may be made with respect to liner 48 to compensate for the varying parameters of powder material 56 between the apex 52 and the skirt 54.

If, for example, the variable parameter is density, the thickness of the liner 48 may be changed with the changing density. In an embodiment, the lower density region of liner 48 is thinner and the higher density region of liner 48 is thicker to maintain jet continuity. In some applications, discontinuities in the formed jet may be minimized by constructing liner 48 such that the liner 48 has continuity satisfying d(alpha)/dx and d(rho)/dx where alpha is the liner half angle, rho is the liner density, and x is the axial distance along the liner 48.

Liner 48 may be formed in many sizes and structures with various patterns and mixtures of powder material compositions. Additionally, the liner may be combined with many types of cases and explosive materials to construct different types of shaped charges and to achieve desired perforation characteristics. The number and arrangement of shaped charges also may be selected according to the parameters of the perforation application and the structure of the perforating gun assembly. The detonation system and the sequence of detonation also may vary from one application to another.

The variation in the structure of the shaped charge liner and/or in the composition of the shaped charge liner can be used to facilitate perforating in many well related applications. The shaped charges described herein may be used in wells drilled from the Earth's surface and in subsea wells. However, the shaped charges and the shaped charge liners also may be used in non-well applications in which perforations are formed through and/or into a variety of materials. The variable characteristics of the liner may be used to achieve the desired jet for optimized perforation performance in many types of applications.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for forming a perforation in a subterranean formation, comprising:

a shaped charge having a case; a liner; and a high explosive pellet positioned between the case and the liner, the liner being formed of a blend of powder and non-powder materials extending along an interior of the case from an apex to a skirt, wherein concentration of components of the powder material used to make portions of the liner varies from the apex to the skirt of the liner, wherein the blend of powder and non-powder materials has a composition that is varied from the apex to the skirt.

2. The system as recited in claim 1, wherein the powder material is powder metal material and the liner is constructed of discrete segments of powder metal materials having different component concentrations moving from the apex to the skirt.

3. The system as recited in claim 1, wherein the powder material is powder metal material and component concentrations vary continuously from the apex to the skirt.

4. The system as recited in claim 1, wherein the powder material of the liner has at least two different metal material compositions moving from the apex to the skirt.

5. The system as recited in claim 1, wherein the powder material of the liner has at least three different material compositions moving from the apex to the skirt.

6. The system as recited in claim 1, wherein the powder material of the liner has at least four different material compositions moving from the apex to the skirt.

7. The system as recited in claim 1, further comprising a perforating gun body, the shaped charge being mounted on the perforating gun body.

8. The system as recited in claim 1, wherein a powder of different density relative to a mean density of the blend of powder materials is added to change the density of the liner at a specific region or regions of the liner.

9. A system for forming a perforation in a subterranean formation, comprising:

a shaped charge having a case; a liner; and a high explosive pellet positioned between the case and the liner, the liner being formed of a variety of materials having a variety of compositions at different regions from an apex to a skirt of the liner, wherein the liner comprises a blend of powdered and non-powdered material with a composition that is varied from the apex to the skirt.

10. The system of claim 9, wherein the liner is constructed of discrete segments having different material compositions moving from the apex to the skirt.

11. The system of claim 9, wherein the liner has a composition that varies continuously from the apex to the skirt.

12. The system of claim 9, wherein the liner comprises a blend of powdered material with a composition that is varied from the apex to the skirt.

13. The system of claim 9, wherein the powdered material includes metal powders and non-metal powders.

14. The system of claim 9, wherein the liner comprises zones of different composition.

15. The system of claim 14, wherein the zones are discrete segments, each having a different composition.

16. The system of claim 15, wherein zones closer to the apex are formed from materials having a first density and zones closer to the skirt are formed from materials having a second density different from the first density.

17. A system for forming a perforation in a subterranean formation, comprising:

a shaped charge having a case; a liner; and a high explosive pellet positioned between the case and the liner, the liner being formed of a plurality of blends of powder metal and non-powdered material having a variety of compositions at different regions from an apex to a skirt of the liner, wherein the liner comprises a plurality of discrete zones, each with a composition different from the compositions of the other zones.

* * * * *